US009228281B2

(12) United States Patent
Obregon et al.

(10) Patent No.: US 9,228,281 B2
(45) Date of Patent: Jan. 5, 2016

(54) WASH BASKET FOR USE WITH A WASHING MACHINE APPLIANCE

(75) Inventors: Roberto Obregon, Louisville, SC (US); Joshua Flesch, Louisville, KY (US); David Billman, Columbus, OH (US)

(73) Assignee: General Electric Company, Schenectady, NY (US)

( * ) Notice: Subject to any disclaimer, the term of this patent is extended or adjusted under 35 U.S.C. 154(b) by 942 days.

(21) Appl. No.: 13/348,702

(22) Filed: Jan. 12, 2012

(65) Prior Publication Data

US 2013/0180292 A1 Jul. 18, 2013

(51) Int. Cl.

| | |
|---|---|
| ***D06F 39/08*** | (2006.01) |
| ***D06F 37/24*** | (2006.01) |
| ***D06F 7/02*** | (2006.01) |
| ***D06F 13/00*** | (2006.01) |

(52) U.S. Cl.
CPC *D06F 7/02* (2013.01); *D06F 13/00* (2013.01); *D06F 39/083* (2013.01)

(58) Field of Classification Search
CPC .... D06F 37/065; D06F 35/006; D06F 39/088
USPC ..... 68/142, 58, 139
See application file for complete search history.

(56) References Cited

U.S. PATENT DOCUMENTS

| | | | | |
|---|---|---|---|---|
| 2,201,685 | A * | 5/1940 | Lorenzen | D06F 23/04 134/139 |
| 2,313,634 | A * | 3/1943 | Forney | 68/23.5 |
| 3,738,126 | A * | 6/1973 | Smith | 68/18 F |
| 4,809,524 | A * | 3/1989 | Sickert et al. | 68/148 |
| 6,041,626 | A | 3/2000 | Jung | |
| 6,134,925 | A | 10/2000 | Fujii et al. | |
| 6,351,974 | B1 | 3/2002 | Lyu et al. | |
| 6,668,410 | B2 | 12/2003 | Lyu et al. | |
| 7,263,862 | B2 | 9/2007 | Lyu et al. | |
| 7,263,864 | B2 | 9/2007 | Lyu et al. | |

FOREIGN PATENT DOCUMENTS

JP 54100155 A * 8/1979

OTHER PUBLICATIONS

Abstract of JPS54100155 A (Hayashi et al., Aug. 1979).*

* cited by examiner

*Primary Examiner* — David Cormier
*Assistant Examiner* — Irina Graf
(74) *Attorney, Agent, or Firm* — Dority & Manning, P.A.

(57) ABSTRACT

A wash basket has a plurality of fins mounted to the wash basket. The plurality of fins is configured to deliver a flow of wash fluid to the top of the wash basket using e.g., a conduit between the bottom and the top of the wash basket where the wash fluid may be directed to articles disposed within the wash basket.

18 Claims, 4 Drawing Sheets

FIG. –1–

WASH BASKET FOR USE WITH A WASHING MACHINE APPLIANCE

FIELD OF THE INVENTION

The subject matter of the present disclosure relates to a wash basket for use with a washing machine appliance and, more particularly, to a wash basket having features for the recirculation of fluid in the wash tub.

BACKGROUND OF THE INVENTION

Preferably, washing machine appliances are designed with features that can help conserve water. Conventionally, certain washing machines filled a wash chamber with wash fluid (e.g., water and detergent) until articles within the chamber were submerged by the wash fluid. Because cleaning of articles often may not require the articles to be submerged in wash fluid, such washing machines often consumed more water than necessary during the wash process.

Accordingly, to conserve water, washing machines can be designed to operate without filling the wash chamber with wash fluid such that articles in the chamber are submerged in the wash fluid. Rather, to soak the articles with wash fluid, such washing machines can pump wash fluid from a bottom of the wash chamber to a top of the wash chamber. The wash basket is rotated, and wash fluid that is pumped to the top of the wash chamber is then directed (e.g., sprayed or drizzled) onto the articles in the wash chamber below. Because the articles are rotating with the wash basket and the wash fluid is spraying onto them, the articles in the wash chamber are soaked with wash fluid and washed clean.

However, in these conventional designs, wash fluid is pumped to the top of the wash chamber using an electrical pump. Such electrical pumps are often configured exclusively for pumping wash fluid from the bottom of the chamber to the top of the chamber. Such pumps can add significantly to the overall cost of a washing machine appliance while only performing a single function. In addition, the electrical pump described above consumes electrical energy and thus decreases the efficiency of such washing machine appliances.

Accordingly, a washing machine that can recirculate fluid to the top of the wash basket would be useful. Such a washing machine that can recirculate fluid without the use of a dedicated pump would be particularly useful.

BRIEF DESCRIPTION OF THE INVENTION

Aspects and advantages of the invention will be set forth in part in the following description, or may be obvious from the description, or may be learned through practice of the invention.

In a first embodiment, an appliance is provided. The appliance includes a cabinet and a wash tub received in the cabinet. The wash tub is configured for containing fluids used in a washing process. The wash tub also extends between a bottom portion and a top portion. A wash basket is mounted in the wash tub. The wash basket is configured for the receipt of articles during the washing process and for rotation about an axis. The wash basket is substantially cylindrical. A plurality of fins projects radially from the wash basket. The appliance also includes a conduit extending between an inlet and an outlet. The inlet of the conduit is positioned adjacent the plurality of fins. The outlet of the conduit is positioned adjacent the top portion of the drum. The conduit is configured for directing a flow of fluid from the bottom portion of the wash tub to the top portion of the wash tub.

In a second embodiment, a wash basket for a washing machine appliance is provided. The washing machine appliance has a cabinet and a wash tub received in the cabinet. The wash tub is configured for containing fluids used in a washing process. The wash basket is configured to rotate in the wash tub. The wash basket is also configured for receipt of articles during the washing process. The wash basket includes a drum. The drum extends between a top section and a bottom section. The top section of the drum defines an opening for receipt of articles for washing. A bottom panel is positioned adjacent the bottom section of the drum. The bottom panel is substantially circular. A plurality of fins extends radially from a circumferential edge of the bottom panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
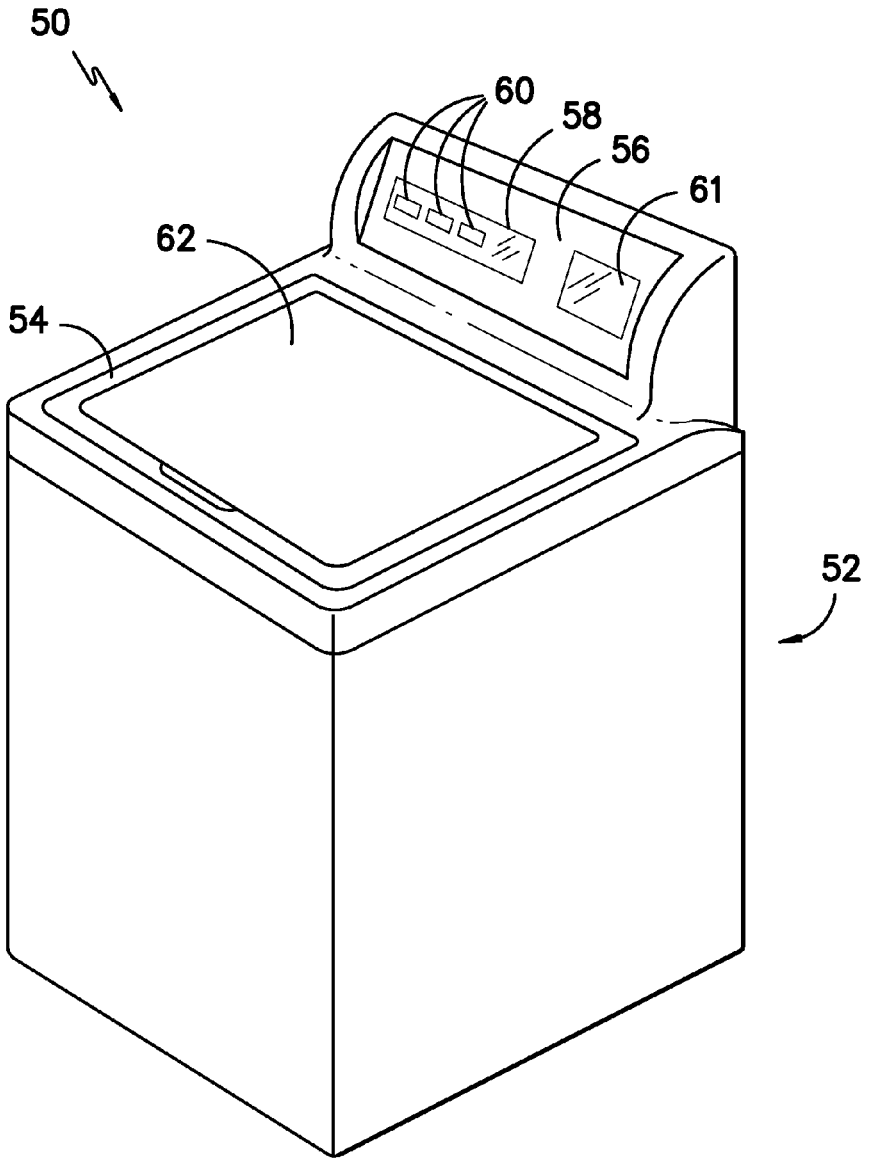
FIG. 1 provides a perspective view of a washing machine according to an exemplary embodiment of the present subject matter.

The present subject matter provides a wash basket that has a plurality of fins mounted to the wash basket. The plurality of fins is configured to deliver a flow of wash fluid to the top of the wash basket using e.g., a conduit between the bottom and the top of the wash basket where the wash fluid may be directed to articles disposed within the wash basket. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary vertical axis washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable about a hinge (not shown) between an open position (not shown) facilitating access to wash tub 64 (shown in FIG. 2) located within cabinet 52 and a closed position (shown in FIG. 1) forming an enclosure over a wash tub 64 shown in FIG. 2.

Figure 2:
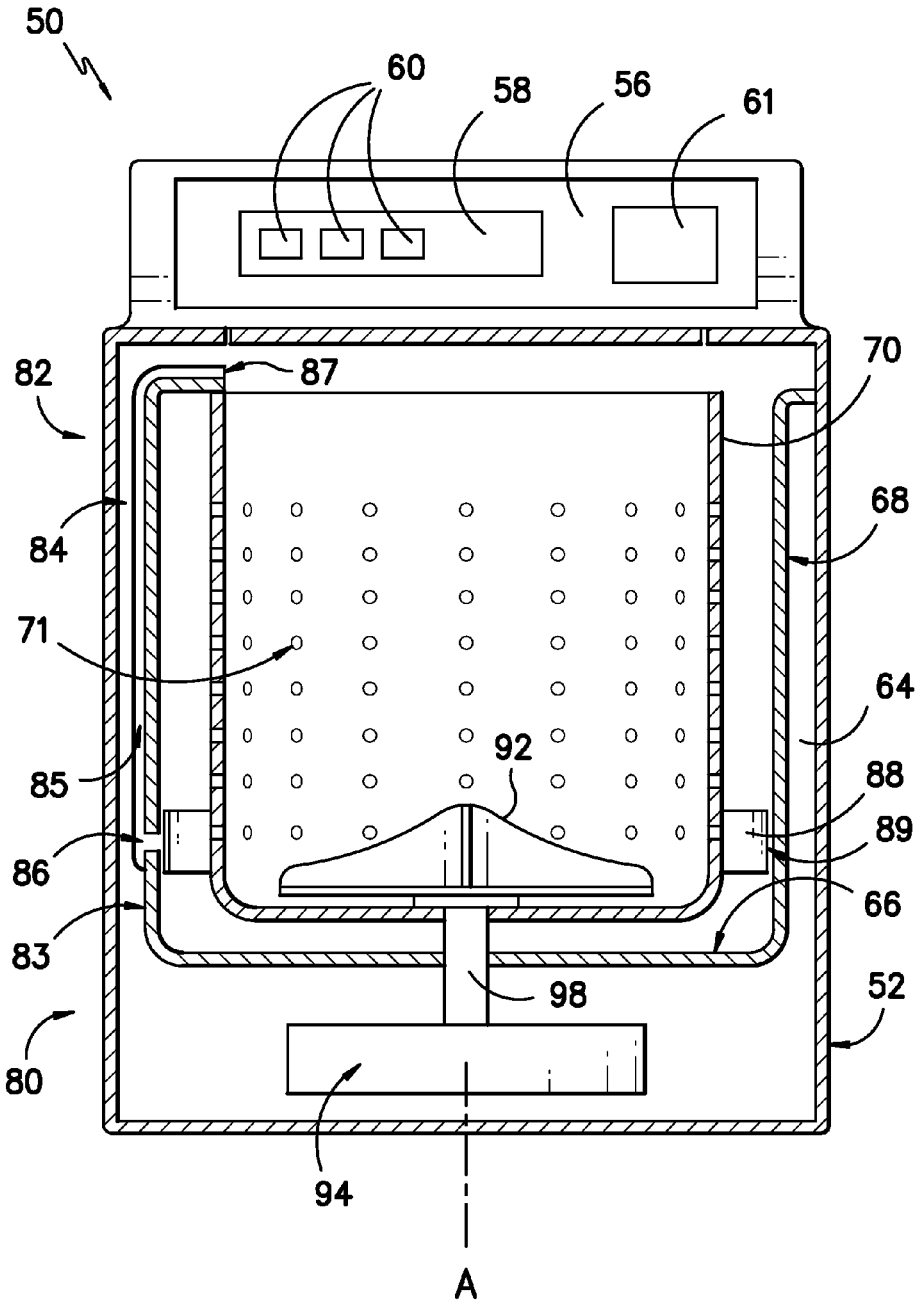
FIG. 2 provides a partial, cross-sectional view of the exemplary washing machine of FIG. 1.

FIG. 2 provides a partial cross-sectional view of the exemplary washing machine 50 of FIG. 1. As shown, wash tub 64 includes a bottom wall 66 and a sidewall 68. Wash tub 64 may be fixedly mounted in cabinet 52 such that wash tub 64 does not rotate. A basket 70 is rotatably mounted within wash tub 64. A pump assembly (not shown) is located beneath tub 64 and basket 70 for gravity assisted flow when draining tub 64. Basket 70 includes a plurality of perforations 71 therein to facilitate fluid communication between an interior of basket 70 and wash tub 64.

A conduit 84 is positioned adjacent an outer surface 83 of wash tub 64. Conduit 84 extends between an inlet 86 positioned adjacent a bottom 80 of wash tub 64 and an outlet 87 positioned adjacent a top 82 of wash tub 64. Conduit 84 is configured for directing a flow of wash fluid from bottom 80 of wash tub 64 to top 82 of wash tub 64 in a channel 85 defined by conduit 84. In various embodiments, conduit 84 may be a pipe, tube, or any other suitable mechanism for directing a flow of fluid. Also, a plurality of fins 88 extend from wash basket 70. Fins 88 have distal ends 89 positioned adjacent wash tub 64 at inlet 86 of conduit 84.

An agitation element 92, such as a vane agitator, impeller, auger, or oscillatory basket mechanism, or some combination thereof, is disposed in basket 70 to impart an oscillatory motion to articles and liquid in basket 70. In different embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about a vertical axis A. Basket 70 and agitator 92 are driven by motor 94. As motor output shaft 98 is rotated, basket 70 and agitation element 92 are operated for rotatable movement within wash tub 64. Washing machine 50 may also include a clutch assembly (not shown) selectively applied or released for respectively maintaining basket 70 in a stationary position within tub 64 or for allowing basket 70 to spin within tub 64.

Operation of machine 50 is controlled by a controller or processing device (not shown), that is operatively coupled to the user interface input located on washing machine backsplash 56 for user manipulation to select washing machine cycles and features. In response to user manipulation of the user interface input, the controller operates the various components of machine 50 to execute selected machine cycles and features.

In an illustrative embodiment, laundry items are loaded into basket 70, and washing operation is initiated through operator manipulation of control input selectors 60. Wash tub 64 is filled with water and mixed with detergent to form a wash fluid. One or more valves (not shown) can be controlled by washing machine 50 to provide for filling tub 64 to the appropriate level for the amount of articles being washed. Once tub 64 is properly filled with fluid, the contents of the basket 70 are agitated with agitation element 92 for cleansing of laundry items in basket 70. More specifically, agitation element 92 is moved back and forth in an oscillatory motion.

In order to conserve water, wash tub 64 may be filled with an amount of wash fluid (e.g., detergent and/or water) such that the articles disposed in wash basket 70 are not submerged in the wash fluid. However, in order to clean the articles, wash fluid should be delivered to the articles such that the articles are soaked in or saturated with wash fluid. Accordingly, as described in more detail below, wash fluid from a bottom 80 of the wash tub 64 is delivered to a top 82 of the wash tub 64 via conduit 84. Wash fluid at top 82 of wash tub 64 may fall onto the articles disposed within wash basket 70 in order to saturate the articles with wash fluid.

After the agitation phase of the wash cycle is completed, tub 64 is drained. Laundry articles can then be rinsed by again adding fluid to wash tub 64, depending on the particulars of the cleaning cycle selected by a user, agitation element 92 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

Figure 3:
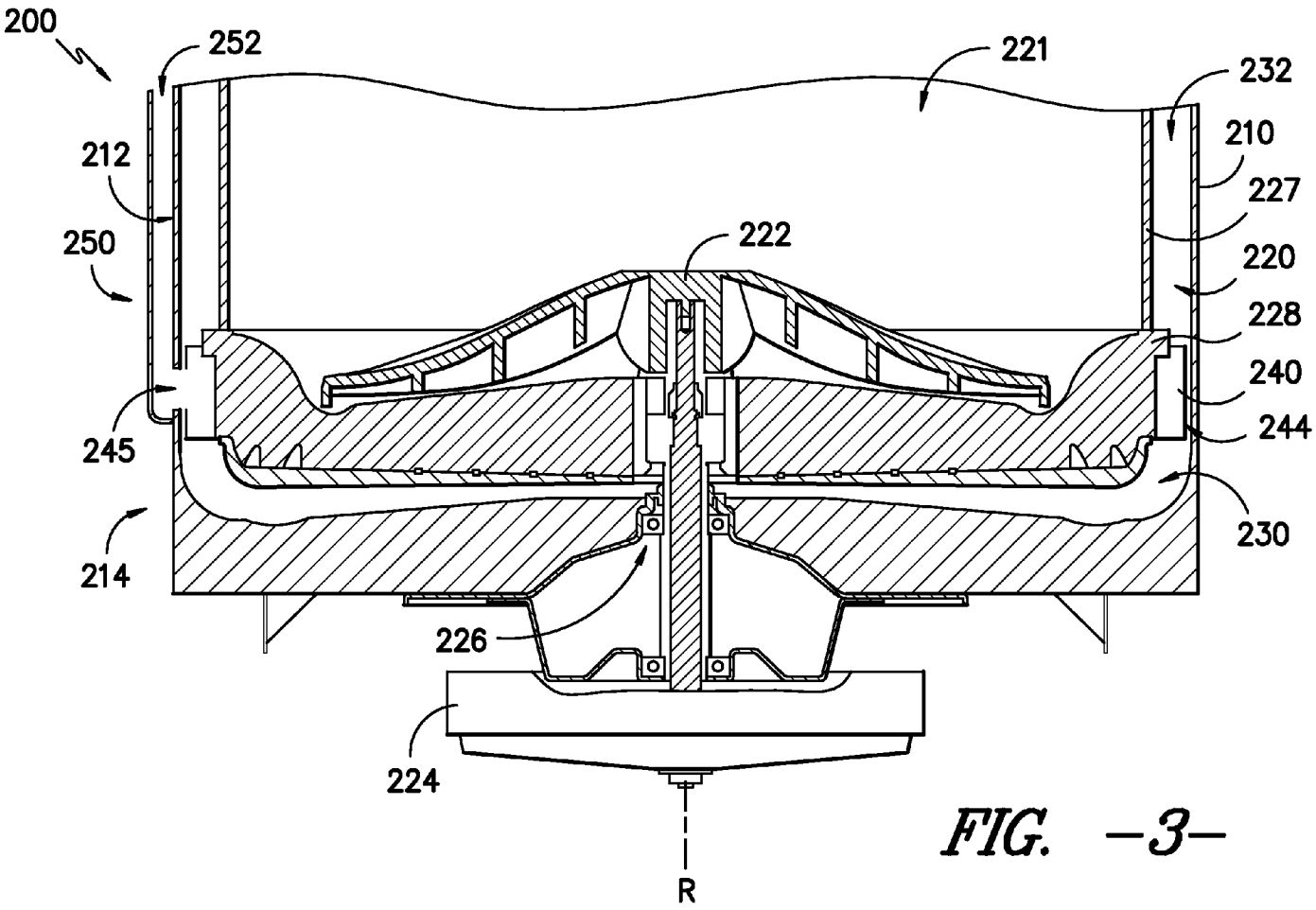
FIG. 3 illustrates a partial, cross-sectional view of an exemplary embodiment of a wash tub and wash basket.
Figure 4:
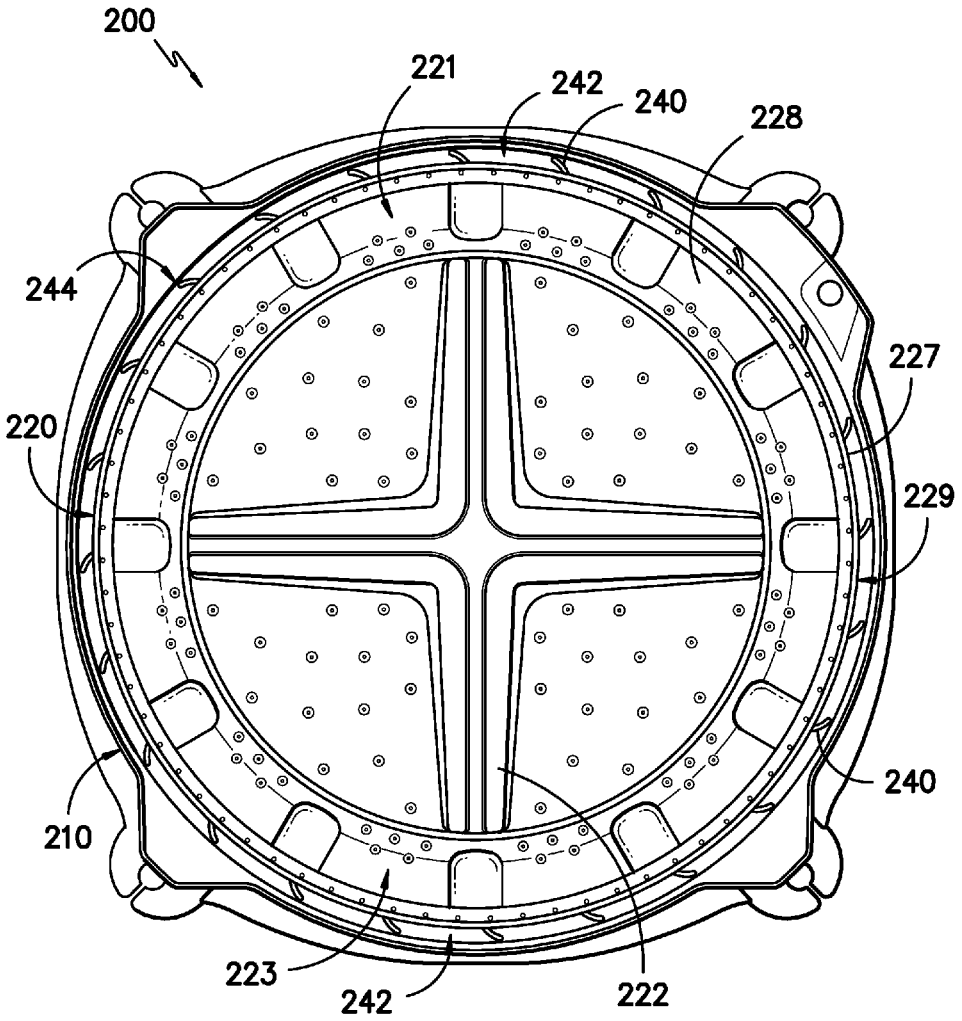
FIG. 4 illustrates a top view of the wash basket and wash tub of FIG. 3.

FIGS. 3 and 4 illustrate a wash tub 210 and a wash basket 220 of a washing machine appliance 200. Wash basket 220 defines a chamber 221 for receipt of articles for washing. Wash basket 220 has an impeller 222 rotatably mounted within chamber 221 to agitate articles located therein during a wash cycle of washing machine appliance 200. Impeller 222 and wash basket 220 are rotated by a motor 224 about an axis R. Impeller 222 and wash basket 220 may be rotated simultaneously or independently by motor 224. To selectively adjust between simultaneous and independent rotation of wash basket 220 and impeller 222, motor 224 mechanically communicates with wash basket 220 and impeller 222 via a clutch assembly 226.

Wash basket 220 includes a drum 227 and a bottom panel 228. Drum 227 has a substantially cylindrical shape and may define a plurality of holes 223 for facilitating a flow of wash fluid between wash basket 220 and wash tub 210. Bottom panel 228 is positioned adjacent impeller 222 at a bottom 214 of wash tub 210.

A cavity 230 is defined between bottom panel 228 and wash tub 210. In addition, a gap 232 is defined between drum 227 and wash tub 210. Cavity 230 and gap 232 may fill with wash fluid during operation of washing machine appliance 200. A plurality of fins 240 project radially from a circumferential edge 229 of bottom panel 228. Fins 240 are positioned adjacent cavity 230 and gap 232 such that spaces 242 between fins 240 are in fluid communication with cavity 230 and gap 240. Also, distal ends 244 of fins 240 are positioned adjacent wash tub 210. In alternative embodiments, fins 240 may project downwardly from bottom panel 228, both radially and downwardly from bottom panel 228, or in any other suitable fashion.

As shown in FIG. 4, fins 240 may define an arcuate profile. However, in alternative embodiments, fins 240 may define any suitable profile, e.g., a linear or a curved profile. In addition, in FIG. 4, fins 240 extend from circumferential edge 229 of bottom panel 228 at an arcuate angle. However, in alternative embodiments, fins 240 may extend from circumferential edge 229 of bottom panel 228 at any suitable angle, e.g., a right angle or an obtuse angle. Also, as shown in FIG. 4, fins 240 are uniformly disposed about circumferential edge 229 of bottom panel 228. However, in alternative embodiments, fins 240 may be distributed about circumferential edge 229 of bottom panel 228 non-uniformly.

In FIG. 3, wash tub 210 has a conduit 250 adjacent outer surface 212 of wash tub 210. Conduit 250 is configured for directing a flow of wash fluid through a channel 252 of conduit 250. Conduit 250 has an inlet 245 positioned adjacent a bottom 214 of wash tub 210. Inlet 245 of conduit 250 is also positioned adjacent at least one of the distal ends 244 of fins 240. In addition, conduit 250 has an outlet (not shown, e.g., outlet 87 of conduit 84 of FIG. 1) adjacent a top (not shown, e.g., top 82 of wash tub 64 of FIG. 1) of wash tub 210. Thus, conduit 250 directs a flow of wash fluid from bottom 214 of wash tub 210 to top of wash tub 210.

During operation of washing machine appliance 200, wash basket 220 may be rotated by motor 224 while wash tub 210 remains stationary (i.e., does not rotate). During such operation, wash fluid fills cavity 230 and at least a portion of gap 232. Accordingly, wash fluid from cavity 230 and gap 232 fills spaces 242 between fins 240. As wash basket 220 rotates at a relatively moderate speed, fins 240 also rotate, and, in turn, wash fluid within spaces 242 rotates as well. As the wash fluid is rotated by fins 240, fins 240 and the momentum of the wash fluid urge the wash fluid into channel 252 of conduit 250 at inlet 254. As additional wash fluid is urged into channel 252, wash fluid flows through channel 252 of conduit 250 from bottom 214 of wash tub 210 to top of wash tub 210. At top of wash tub 210, wash fluid may be directed onto articles within chamber 221 of wash basket 220. Once, back in the chamber 221, due to the rotation of wash basket 220 and gravity, the wash fluid may flow back to cavity 230 or gap 232, and, in turn, repeat the process described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a cabinet;

a wash tub received in said cabinet and configured for containing fluids used in a washing process, said wash tub including a bottom portion and a top portion;

a wash basket mounted in said wash tub, said wash basket configured for the receipt of articles during the washing process and for rotation about an axis, said wash basket being substantially cylindrical;

a plurality of fins projecting from said wash basket; and a conduit positioned on an outer surface of said wash tub, said conduit extending between an inlet and an outlet on the outer surface of said wash tub, the inlet of said conduit positioned adjacent the bottom portion of said wash tub, the outlet of said conduit positioned adjacent the top portion of said wash tub, said conduit configured for directing a flow of a wash fluid from the bottom portion of said wash tub to the top portion of said wash tub, at least one fin of said plurality of fins positioned adjacent the inlet of said conduit at the bottom portion of said wash tub, wherein said plurality of fins is configured for urging the wash fluid in said wash tub into the inlet of said conduit and out of the outlet of said conduit during rotation of said wash basket, the outlet of sail conduit positioned for directing the wash fluid in said conduit into said wash basket.

2. The appliance of claim 1, wherein each of said plurality of fins has an arcuate profile.

3. The appliance of claim 1, wherein each of said plurality of fins extends from said wash basket at an acute angle.

4. The appliance of claim 3, wherein each of said plurality of fins has an arcuate profile.

5. The appliance of claim 1, wherein said conduit comprises a tube.

6. The appliance of claim 1, wherein a distal end of each of said plurality of fins is positioned adjacent said wash tub.

7. The appliance of claim 1, wherein said plurality of fins is uniformly distributed about said wash basket.

8. The appliance of claim 1, further comprising a motor in mechanical communication with said wash basket such that said motor selectively rotates said wash basket about the axis.

9. The appliance of claim 8, further comprising an impeller positioned within said wash basket, said impeller being in mechanical communication with said motor such that said motor selectively rotates said impeller about the axis.

10. The appliance of claim 1, wherein said wash tub is fixedly mounted in said cabinet.

11. A washing machine appliance, comprising:

a cabinet;

a tub positioned within the cabinet, the tub including a top portion and a bottom portion, the tub configured for containing a wash fluid;

a wash basket rotatably mounted within the tub, the wash basket comprising:

a drum defining an opening at a top of the drum for receipt of articles for washing;

a bottom panel positioned at a bottom of the drum, the bottom panel being substantially circular; and a plurality of fins extending radially from the bottom panel; and a conduit positioned at an outer surface of the tub and extending between an inlet and an outlet, the inlet of the conduit positioned at the bottom portion of the tub, the outlet of the conduit positioned at the top portion of the tub, the conduit configured for directing a flow of the wash fluid from the bottom portion of the tub to the top portion of the tub when the wash basket spins within the tub, at least one fin of the plurality of fins positioned adjacent the inlet of the conduit at the bottom portion of the tub, wherein the plurality of fins is configured for urging the wash fluid in the tub into the inlet of the conduit during rotation of the wash basket, the outlet of the conduit positioned for directing the wash fluid in the conduit into the wash basket.

12. The washing machine appliance of claim 11, wherein the plurality of fins project radially from a circumferential edge of the bottom panel.

13. The washing machine appliance of claim 12, wherein the plurality of fins is uniformly distributed about the circumferential edge of the bottom panel.

14. The washing machine appliance of claim 11, wherein each of the plurality of fins has an arcuate profile.

15. The washing machine appliance of claim 11, wherein each of the plurality of fins extends from the bottom panel at an acute angle.

16. The washing machine appliance of claim 15, wherein each of the plurality of fins has an arcuate profile.

17. The washing machine appliance of claim 11, wherein the drum defines a plurality of holes.

18. The washing machine appliance of claim 11, further comprising an impeller disposed adjacent a top surface of the bottom panel.

* * * * *